US006179123B1

(12) United States Patent
Shigeta et al.

(10) Patent No.: US 6,179,123 B1
(45) Date of Patent: Jan. 30, 2001

(54) LIGHT-SHIELDING PACKAGING SYSTEM FOR PHOTOSENSITIVE WEB ROLL

(75) Inventors: Bungo Shigeta; Hirofumi Abe; Yasuhiko Kitamura; Yoshio Hara, all of Minami-ashigara (JP)

(73) Assignee: Fuji Photo Film Co., Ltd., Kanagawa (JP)

( * ) Notice: Under 35 U.S.C. 154(b), the term of this patent shall be extended for 0 days.

(21) Appl. No.: 09/466,070

(22) Filed: Dec. 17, 1999

(30) Foreign Application Priority Data

Dec. 17, 1998 (JP) ..... 10-358705
Feb. 26, 1999 (JP) ..... 11-050946
Jul. 30, 1999 (JP) ..... 11-217209

(51) Int. Cl.[7] ..... B65D 65/16; B65D 85/67

(52) U.S. Cl. ..... 206/410; 53/442; 206/413; 206/497; 428/172

(58) Field of Search ..... 53/442; 206/316.1, 206/410, 413, 416, 455, 497; 242/348.4; 430/501; 428/172

(56) References Cited

U.S. PATENT DOCUMENTS 4,911,299 * 3/1990 Peeters ..... 206/410
5,222,601 * 6/1993 Takahashi et al. ..... 206/416
5,346,067 * 9/1994 Haufe et al. ..... 206/497
5,411,843 * 5/1995 Marien et al. ..... 430/501
5,472,089 * 12/1995 Specogna et al. ..... 206/413
6,095,330 * 8/2000 Essert et al. ..... 206/410

FOREIGN PATENT DOCUMENTS

0181417 * 5/1986 (EP) .

* cited by examiner

*Primary Examiner*—Jim Foster
(74) *Attorney, Agent, or Firm*—Sughrue, Mion, Zinn, Macpeak & Seas, PLLC

(57) ABSTRACT

A light-shielding packaging for a roll of continuous photosensitive web wound on a core having on its both ends a light-shielding flange disc has at its leading end a heat-shrinkable light-shielding leader sheet having a thickness of 30 to 200 $\mu$m which shows a heat shrinkage ratio of 5 to 30% in the longitudinal direction of the web at a temperature in the range of 60 to 140° C. and a heat shrinkage ratio of less than 5% in its width direction at the same temperature. The leader sheet has a length larger than the length of the outermost convolution of the roll and a width larger than the distance between the outer face of one flange disc and the outer face of another flange disc, and each side portion of the leader sheet is light-tightly attached by heat shrinkage to the outer face of the flange disc at least at a portion adjacent to the periphery of the flange disc.

20 Claims, 11 Drawing Sheets

LIGHT-SHIELDING PACKAGING SYSTEM FOR PHOTOSENSITIVE WEB ROLL

FIELD OF THE INVENTION

The present invention relates to a continuous photosensitive web having a leader portion and further relates to a light-shielding packaging for a roll of the photosensitive web.

BACKGROUND OF THE INVENTION

A light-shielding packaging for a roll of continuous photosensitive web wound on a core having on its both ends a light-shielding flange disc is known and actually utilized, particularly, for the purpose of roomlight loading of a roll of continuous photosensitive web into a camera or other image-forming apparatus in which the photosensitive web is to be exposed.

European Patent Application No. 0 181 417 A1 (issued on May 21, 1986) discloses a packaging of rolls of light-sensitive material such as strip of photographic film or paper, for roomlight loading. The packaging comprises opaque material which protects the rolled material from light while leaving a leader of the rolled material exposed and which can be torn by pulling on such leader to cause the light-sensitive material to commence unwinding from the roll. A piece of heat-shrinkable sheet material is used together to cover the leader as well as a portion of the light-sensitive material.

U.S. Pat. No. 4,733,777 (issued on Mar. 29, 1988) and European Patent Specification 0 230 057 B1 (issued on May 16, 1990) disclose a light-tightly packaged roll of light-sensitive material, which comprises an annular end cover for each end face of the roll and a circumferential cover wound around the periphery of the roll and having lateral extensions sealed with their inner surface to the inner surface of radially outwardly projecting margings of the end covers.

U.S. Pat. No. 4,911,299 (issued on Mar. 27, 1990) discloses a strip of light sensitive material wound in a coil onto an open-ended core which is packaged in tearable light tight wrapping material protecting the rolled web while leaving an exterior end of the coil exteriorly accessible. The light tight wrapping material is tearable by pulling on the exterior end to commence unwinding of the coil from the core.

European Patent Application 0 681 212 A1 (issued on Nov. 8, 1995) and U.S. Pat. No. 5,472,089 (issued on Dec. 5, 1995) disclose a light-tight packaging for photosensitive web roll having a flexible leader portion that overwraps the outermost first convolution of the roll. The leader has three stretchable segments in which can cooperate with light-shielding flange portions to form light-tight labyrinth-type sealing.

Thus, for the purpose of satisfactory light-tight sealing, known packagings for photosensitive web utilize overall light-shielding sealing which is tearable when the leader is pulled to commence unwinding of the photosensitive web, or structural sealing such as labyrinth-type sealing.

SUMMARY OF THE INVENTION

The present invention has an object to provide a new light-shielding packaging system for a roll of continuous photosensitive web wound on a core having on its both ends a light-shielding flange disc.

The invention further has an object to provide a continuous photosensitive web having a light-shielding leader sheet, which is favorably employable for the new light-shielding packaging system.

The invention resides in a continuous photosensitive web having at least at its one end a heat-shrinkable light-shielding leader sheet having a thickness of 30 to 200 $\mu$m, preferably 70 to 150 $\mu$m, more preferably 80 to 130 $\mu$m, and comprising a resin material and a colorant which shows a heat shrinkage ratio in the range of 5 to 30%, preferably 10 to 30%, more preferably 15 to 30%, in the longitudinal direction of the web at a temperature in the range of 60 to 140° C., preferably 80 to 120° C., more preferably 90 to 110° C., and a heat shrinkage ratio of less than 5%, preferably less than 4%, more preferably less than 3%, in its width direction at that temperature.

The invention further resides in a light-shielding packaging for a roll of continuous photosensitive web wound on a core having on its both ends a light-shielding flange disc, which has at its leading end a heat-shrinkable light-shielding leader sheet having a thickness of 30 to 200 $\mu$m, preferably 70 to 150 $\mu$m, more preferably 80 to 130 $\mu$m, and comprising a resin material and a colorant which shows a heat shrinkage ratio in the range of 5 to 30%, preferably 10 to 30%, more preferably 15 to 30%, in the longitudinal direction of the web at a temperature in the range of 60 to 140° C., preferably 80 to 120° C., more preferably 90 to 110° C., and a heat shrinkage ratio of less than 5%, preferably less than 4%, more preferably less than 3%, in its width direction at the temperature, said leader sheet having a length larger than the length of the outermost convolution of the roll and a width larger than the distance between the outer face of one flange disc and the outer face of another flange disc, and each side portion of the leader sheet being light-tightly attached via heat shrinkage thereof to the outer face of the flange disc at least at a portion adjacent to the periphery of the flange disc.

The heat shrinkage ratio can be determined under the conditions defined in JIS Z 1709.

A ratio of the heat shrinkage ratio of the leader sheet in the longitudinal direction to the heat shrinkage ratio in the width direction is preferably 3 or more, more preferably 4 or more, most preferably 5 or more.

DETAILED DESCRIPTION OF THE INVENTION

The continuous photosensitive web and light-shielding packaging according to the invention are described below in more detail by referring to the attached drawings.

Figure 1:
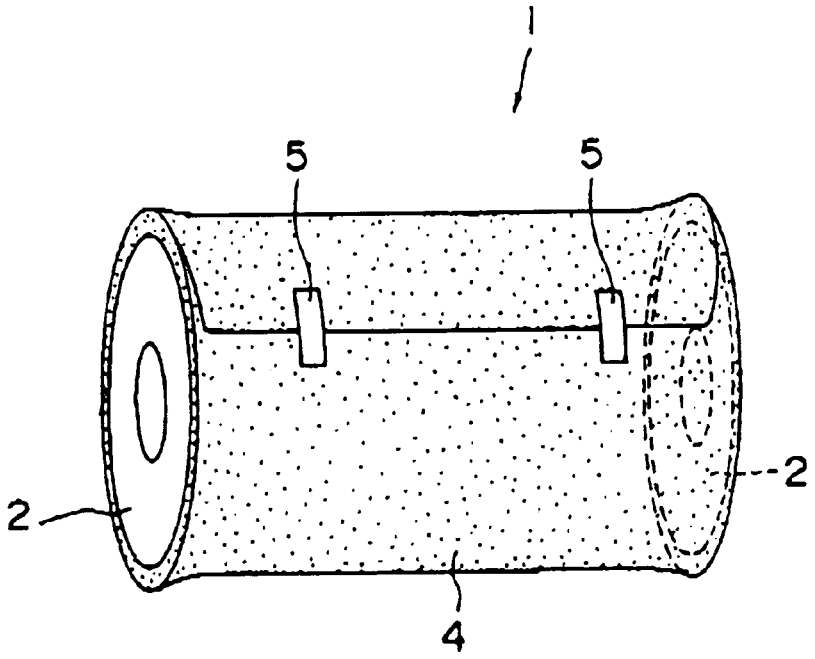
FIG. 1 illustrates an overall view of a light-shielding packaging for a roll of continuous photosensitive web according to the invention.

FIG. 1 gives an overall view of a light-shielding packaging for a roll of continuous photosensitive web according to the invention.

In FIG. 1, a light-shielding packaging 1 comprises a roll of continuous photosensitive web which is wound on a core having on its both ends a light-shielding flange disc 2. The photosensitive web has at its leading end a heat-shrinkable light-shielding leader sheet 4 to keep the outermost convolution of the photosensitive web from being exposed. The leading end of the leader sheet 4 is attached to the surface of the underlying convolution of the leader sheet 4 by an adhesive tape 5.

Figure 2:
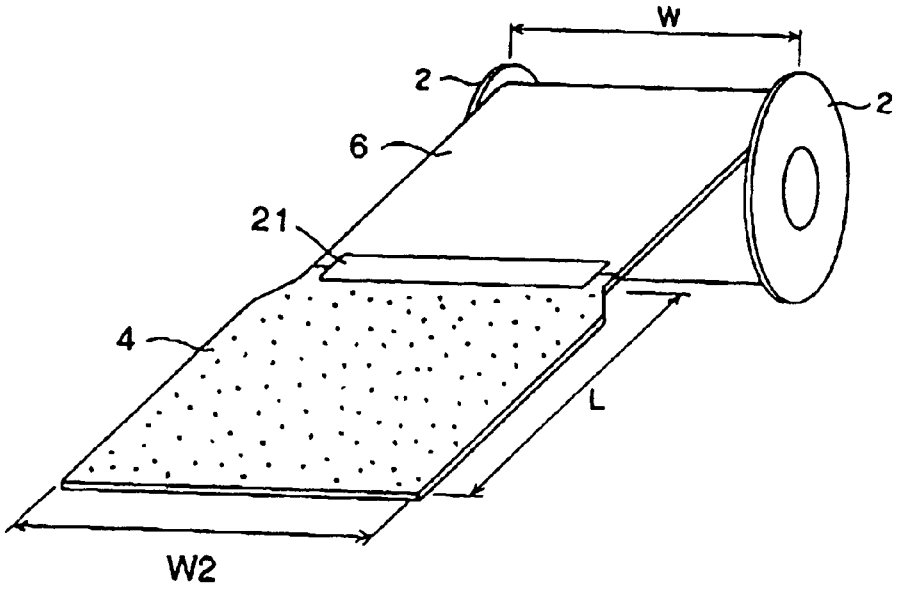
FIG. 2 illustrates a continuous photosensitive web having a heat-shrinkable light-shielding leader sheet at its leading end according to the invention, which is wound on a core having on its both ends a light-shielding flange disc.

FIG. 2 shows a continuous photosensitive web 6 having a heat-shrinkable light-shielding leader sheet 4 at top end. The photosensitive web 6 is wound on a core having on its both ends a light-shielding flange disc 2, and connected to the leader sheet 4 using an adhesive connecting tape 21. The length (L) of the leader sheet generally is more than the circumference of the flange disc 2, and preferably is as much as two times or more of length of the circumference of the flange disc 2. The width ($W_1$) of the leader sheet 4 generally is more than the width (W) of the photosensitive web 6.

Figure 3:
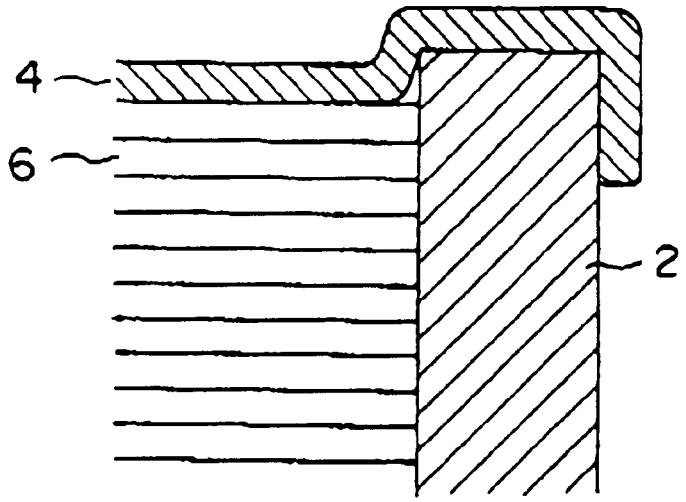
FIG. 3 is a section of one example of the sealing structure formed in the light-shielding packaging of the invention.

FIG. 3 is a section of one example of the sealing structure formed between the flange disc 2 and the light-shielding leader sheet 4, for keeping the photosensitive web 6 from being exposed. The side portion of the leader sheet 4 is bent by heat shrinkage to come into contact with the outer surface of the flange disc 2 in its peripheral area. The heat shrinkage of the side portion of the leader sheet is performed, for instance, by applying a hot air or heating means to the side portion, after the leader sheet is wound to cover the circumference of the flange disc.

Figure 4:
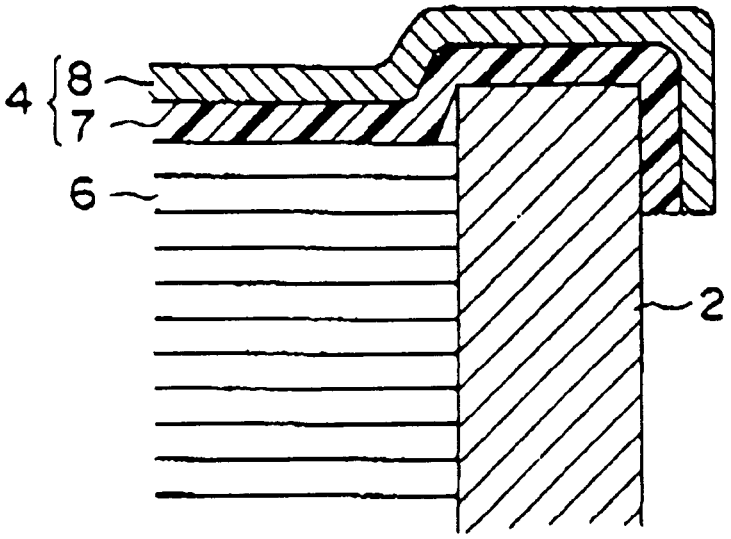
FIG. 4 is a section of another example of the sealing structure formed in the light-shielding packaging of the invention.

FIG. 4 is a section of another example of the sealing structure formed between the flange disc 2 and the light-shielding leader sheet 4, for keeping the photosensitive web 6 from being exposed. In this example, the leader sheet 4 is wound double, that is, numerals 7 and 8, and bent by heat shrinkage to come into contact with the outer surface of the flange disc 2 in its peripheral area.

Figure 5:
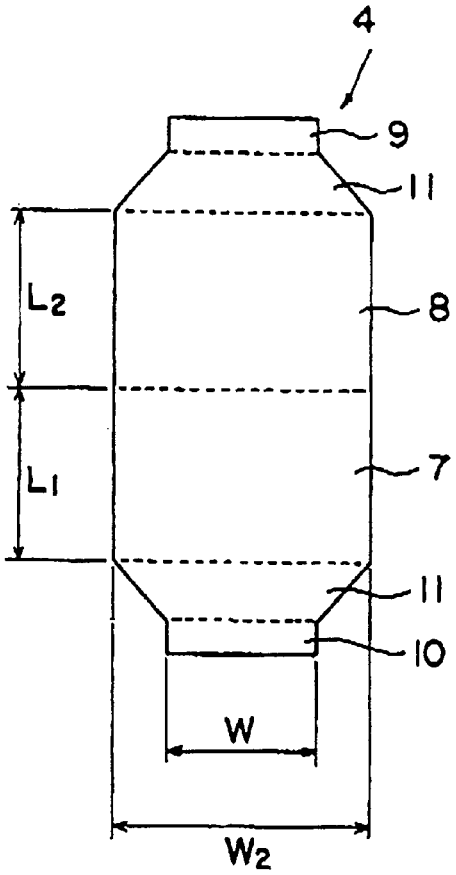
FIG. 5 is a top plain view of the heat-shrinkable light-shielding leader sheet employed for the formation of the sealing structure of FIG. 4.

FIG. 5 is a top plain view of the heat-shrinkable light-shielding leader sheet employed for the formation of the sealing structure of FIG. 4. The leader sheet 4 has segments 7, 8 whose width ($W_2$) is larger than the width (W) of the narrow segment 10 being connected to the photosensitive web having the width (W). The narrow segment 10 continues from the wide segment 7 via a tapered segment 11. At another end of the leader sheet 4, another narrow segment 9 is formed via a tapered segment 11. The lengths $L_1$, $L_2$ of the wide segments 7, 8, respectively, are almost the same as length of the circumference of the flange disc 2.

Figure 6:
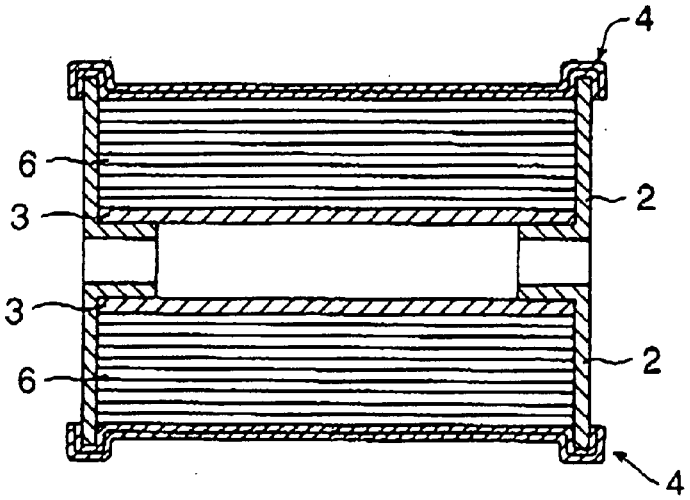
FIG. 6 is a sectional view of the light-shielding packaging utilizing the sealing structure of FIG. 5.

FIG. 6 is a sectional view of the light-shielding packaging 1 which has the sealing structure of FIG. 4. The photosensitive web 6 is wound on the core 3.

Figure 7:
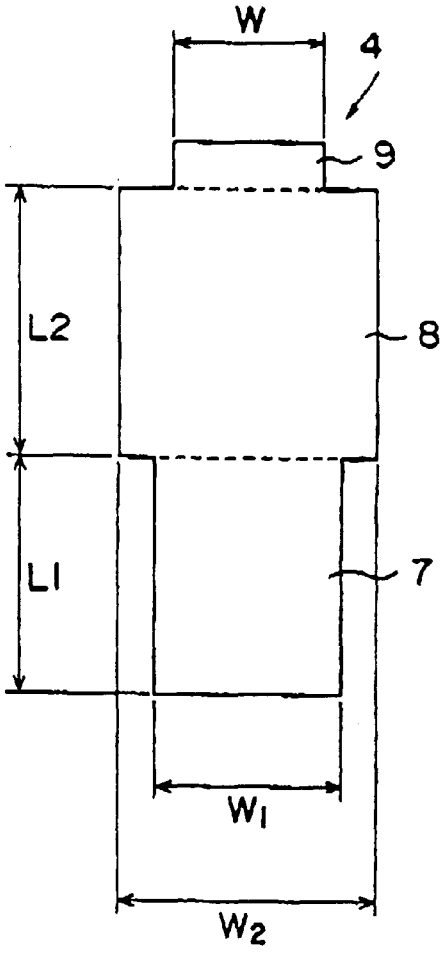
FIG. 7 is a top plain view of a heat-shrinkable light-shielding leader sheet of another type which is also employable in combination with the continuous photosensitive web according to the invention.

FIG. 7 is a top plain view of a heat-shrinkable light-shielding leader sheet 4 of another type. The leader sheet 4 of FIG. 7 has an arrangement similar to that of the leader sheet of FIG. 5, but has no tapered segments. Further, the segment 7 which has a length $L_1$ and is to be connected to the photosensitive web has a width $W_1$ which is the same as the width W of the photosensitive web. However, the segment 8 which has a length $L_2$ and follows the segment 7 has a larger width $W_2$. The lengths $L_1$, $L_2$ of the segments 7, 8, respectively, are almost the same as length of the circumference of the flange disc 2.

Figure 8:
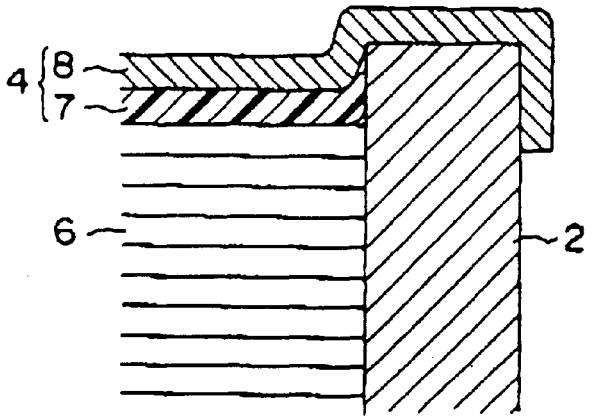
FIG. 8 is a section of a sealing structure formed by employing the leader sheet of FIG. 7.

FIG. 8 shows a section of a sealing structure formed by employing the leader sheet of FIG. 7.

Figure 9:
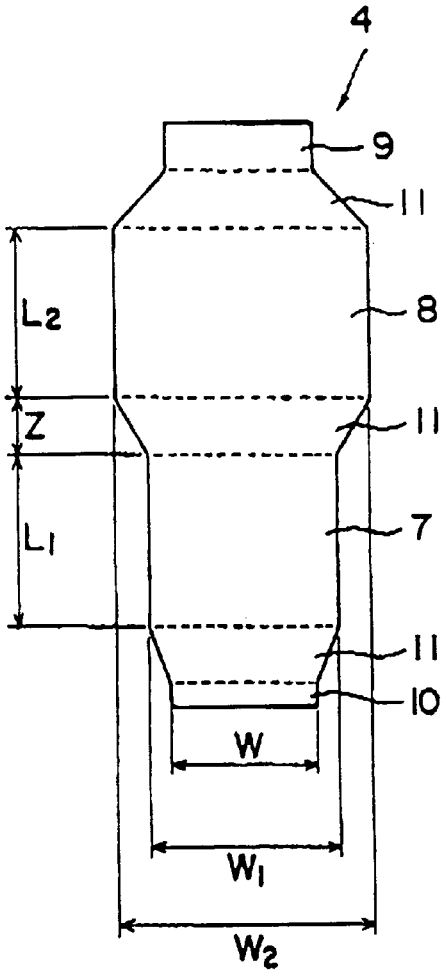
FIG. 9 is a top plain view of a heat-shrinkable light-shielding leader sheet of a different type which is also employable in combination with the continuous photosensitive web according to the invention.

FIG. 9 is a top plain view of a heat-shrinkable light-shielding leader sheet of a different type. The leader sheet 4 of FIG. 9 has an arrangement similar to that of the leader sheet of FIG. 5, but has two wide segments 7, 8 which have a width different from each other. The segment 7 which has a length $L_1$ and is to be connected to the photosensitive web via a combination of a tapered segment 11 and a narrow segment 10 has a width $W_1$ which is larger than the width W of the photosensitive web. The segment 8 which has a length $L_2$ and follows the segment 7 via a tapered segment 11 has a larger width $W_2$. The lengths $L_1$, $L_2$ of the segments 7, 8, respectively, are almost the same as length of the circumference of the flange disc 2.

In FIG. 9, the width W of the photosensitive web, the width $W_1$ of the inner leader segment 7, and the width $W_2$ of the outer leader segment 8 preferably satisfy the following conditions:

width of the photosensitive web=W width of the inner leader segment ($W_1$)=W+2X width of the outer leader segment ($W_2$)=W+2Y

Y>3X.

Figure 10:
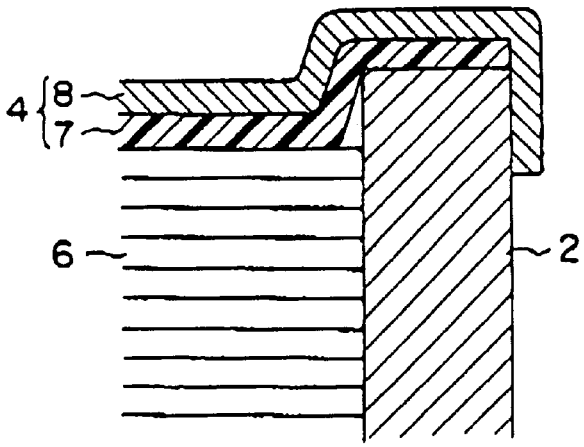
FIG. 10 is a section of one sealing structure formed by employing the leader sheet of FIG. 9.

FIG. 10 shows a section of one sealing structure formed by employing the leader sheet of FIG. 9.

Figure 11:
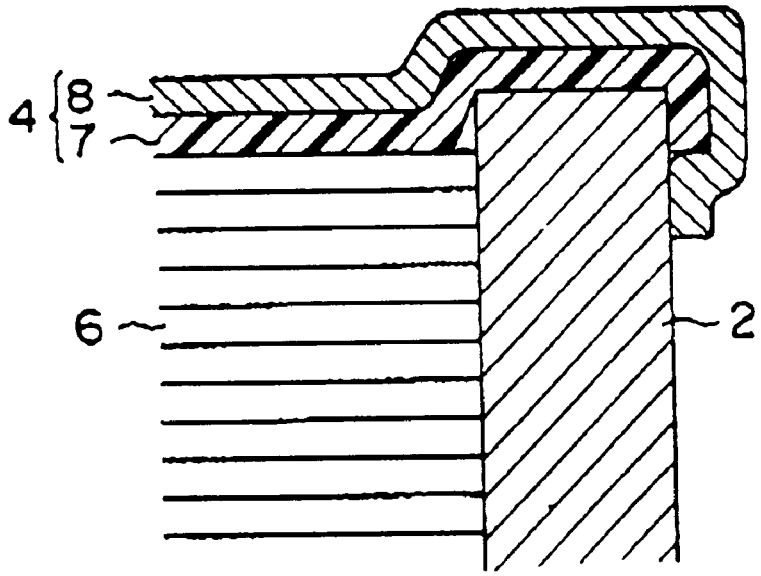
FIG. 11 is a section of another sealing structure formed by employing the leader sheet of FIG. 9.

FIG. 11 shows a section of another sealing structure formed by employing the leader sheet of FIG. 9. In this structure, the width $W_1$ of the segment 7 is larger than the distance between the outer surfaces of the flange discs 2.

Figure 12:
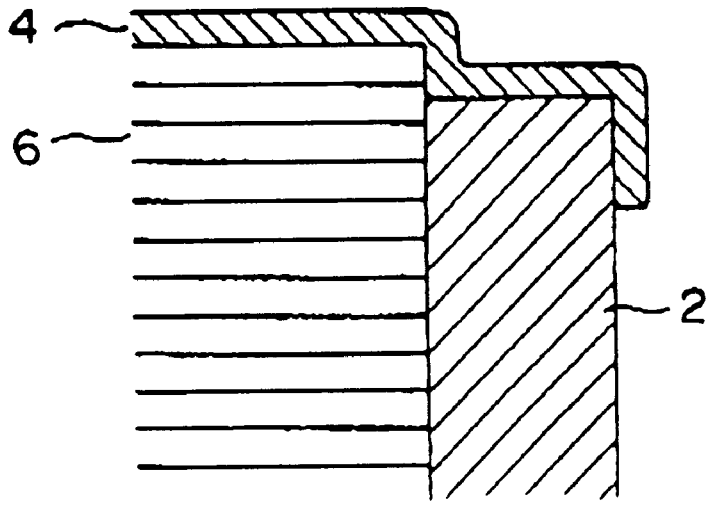
FIG. 12 is a section of a sealing structure formed using a light-shielding flange of another type.

FIG. 12 is a section of a sealing structure formed employing the photosensitive web of FIG. 2 except for using a light-shielding flange which has of a shorter diameter 2.

Figure 13:
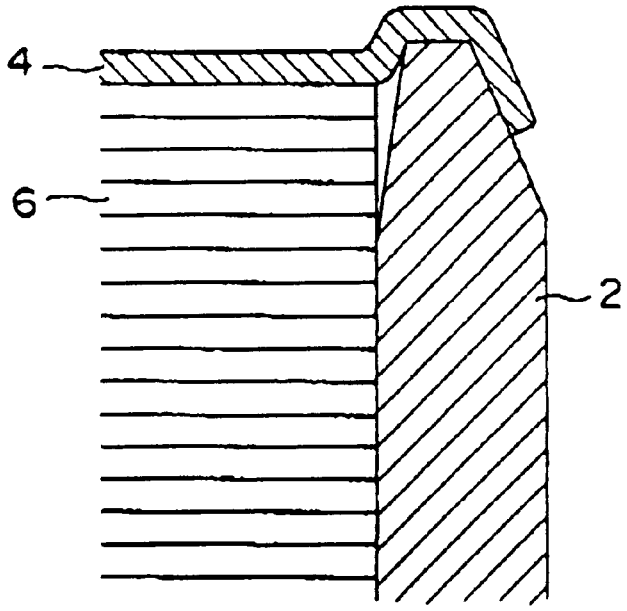
FIG. 13 is a section of a sealing structure formed using a light-shielding flange of a different type.

FIG. 13 is a section of a sealing structure formed employing the photosensitive web of FIG. 2 except for using a light-shielding flange which has of a tapered periphery 2. The use of the light-shielding flange 2 having a tapered periphery is advantageous for smoothly winding the photosensitive web 16 between the flanges 2 and smoothly attaching the side portion of the heat-shrinkable light-shielding leader sheet to the periphery of the flange 2 by heat shrinkage of the side portion.

Figure 14:
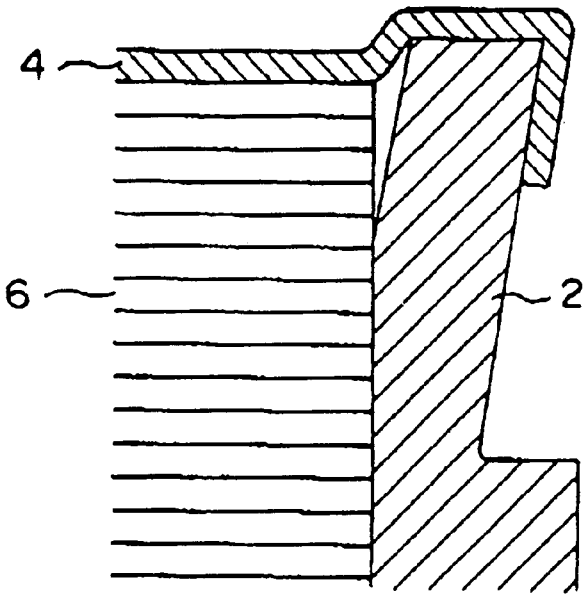
FIG. 14 is a section of a sealing structure formed using a light-shielding flange of a different type.

FIG. 14 is a section of a sealing structure formed employing the photosensitive web of FIG. 2 except for using a light-shielding flange 2 which has of a slanted periphery. The use of the light-shielding flange 2 having a slanted periphery is advantageous for smoothly winding the photosensitive web 16 between the flanges 2 and firmly attaching the side portion of the heat-shrinkable light-shielding leader sheet to the periphery of the flange 2 by heat shrinkage of the side portion.

Figure 15:
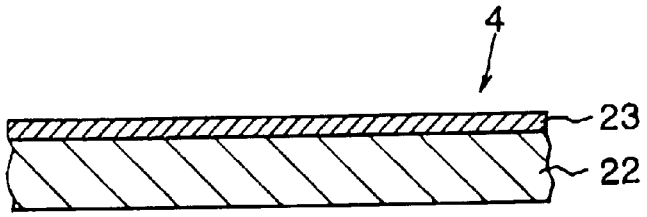
FIG. 15 is a section of a heat-shrinkable light-shielding leader sheet having a heat-resistant layer.

FIG. 15 shows a section of a heat-shrinkable light-shielding leader sheet having a heat-resistant layer, which is also favorably employable in the invention. In this structure, the leader sheet 4 preferably comprises a heat-shrinkable light-shielding plastic film 22 comprising a resin material and a colorant and a heat-resistant layer 3 arranged on one surface side of the plastic film 22. The heat-resistant layer 23 preferably has a softening or decomposing temperature higher than 10° C. of a softening or decomposing temperature of the heat-shrinkable light-shielding plastic film 22. The heat-resistant layer 23 preferably has a thickness in the range of 1/40 to 30/40 per the thickness of the heat-shrinkable light-shielding plastic film 22. The heat-resistant layer 23 is preferably made of a thermosetting resin.

Figure 16:
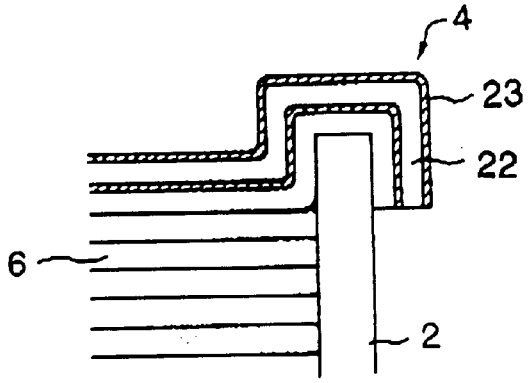
FIG. 16 is a section of a sealing structure formed by employing the leader sheet of FIG. 15.

FIG. 16 shows a section of a sealing structure formed by employing the leader sheet of FIG. 15.

Figure 17:
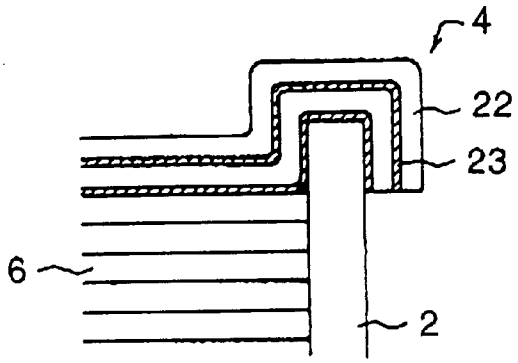
FIG. 17 is a section of another sealing structure formed by employing the leader sheet of FIG. 15.

FIG. 17 shows a section of another sealing structure formed by employing the leader sheet of FIG. 15.

By the use of the leader sheet having the structure of FIG. 15, the leader sheet of the outermost convolution hardly adheres to that of the underlaying convolution, because the heat-resistant layer interposed between the outermost convolution and the underlying convolution keeps one from adhesion of another.

Figure 18:
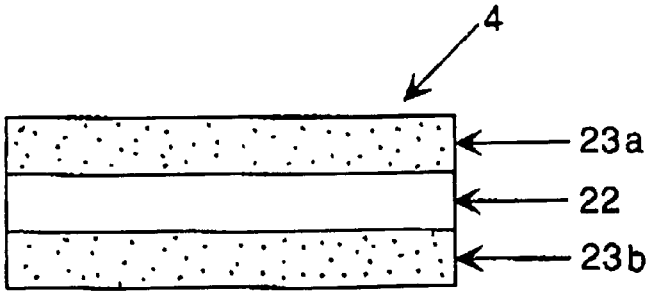
FIG. 18 is a section of a heat-shrinkable light-shielding leader sheet consisting of a heat-shrinkable plastic film and light-shielding films, each of which is placed on each surface of the heat-shrinkable plastic film.

FIG. 18 shows a section of a heat-shrinkable light-shielding leader sheet 4 consisting of a heat-shrinkable plastic film 22 and light-shielding films 23*a*, 23*b*. Each of the light-shielding films 23*a*, 23*b* is placed on each surface of the heat-shrinkable plastic film 22, which is also employable in the invention. The light-shielding film may be placed only on one surface side of the heat-shrinkable plastic film 22.

Figure 19:
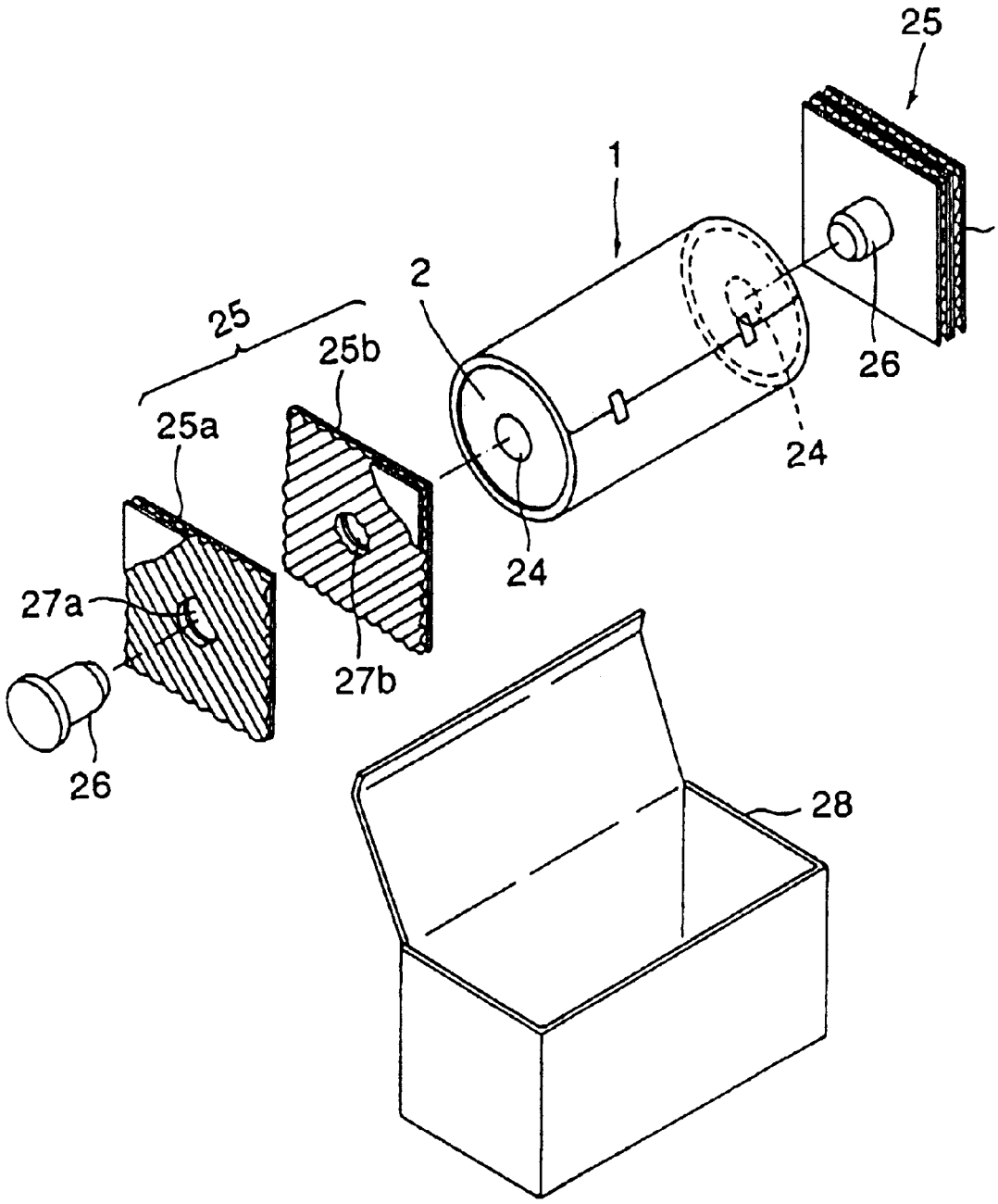
FIG. 19 is a schematic view of encasement of a light-shielding packaging of the invention in a corrugated cardboard box.

FIG. 19 schematically illustrates encasement of a light-shielding packaging of the invention in a corrugated cardboard box. In FIG. 15, the packaged photosensitive web 1 having the light-shielding flange discs 2 and a center hole 24 are supported on both sides by a pair of supporting means 25. The supporting means preferably is made of corrugated cardboard. In FIG. 19, the supporting means 25 consists of a pair of square corrugated cardboards 25*a*, 25*b*. The cardboards 25*a*, 25*b* are arranged in such manner that the corrugating media of the cardboards are arranged perpendicular to each other, as is seen in FIG. 19. The packaged photosensitive web 1 is supported by the supporting means 25 using a connecting means 13 which is pushed into the hole 24 of the package through the hole 27*a*, 27*b* of the supporting means 25. Thus supported package is then encased in a corrugated cardboard box 28.

Figure 20:
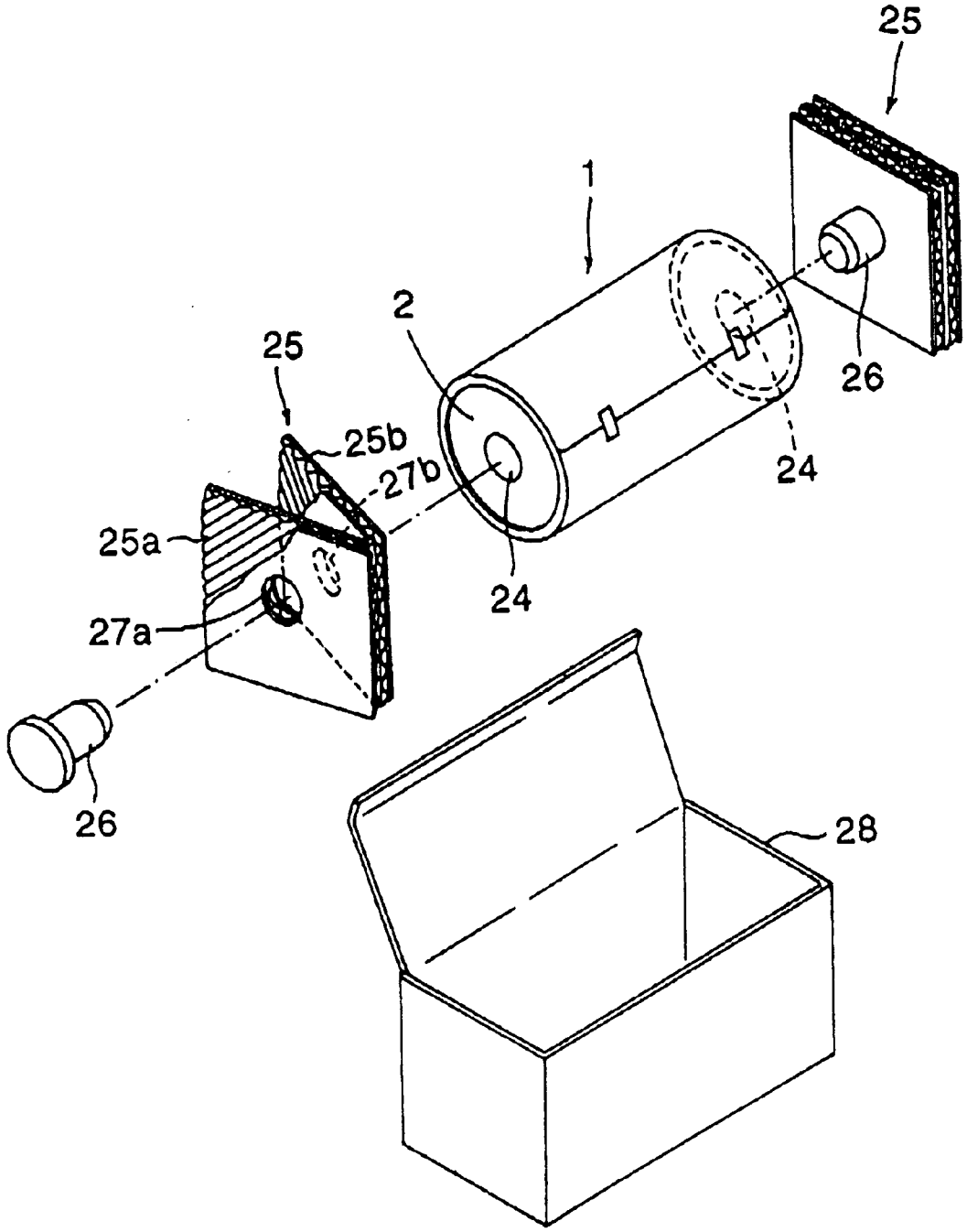
FIG. 20 is another schematic view of encasement of a light-shielding packaging of the invention in a corrugated cardboard box.

FIG. 20 is another schematic view of encasement of a light-shielding packaging of the invention in a corrugated cardboard box. In this embodiment, the supporting means 25 is composed of a pair of the square corrugated cardboards 25*a*, 25*b* which is formed by bending one cardboard.

The heat-shrinkable light-shielding leader sheet of the invention comprises a resin material and a colorant, and may be a single layer sheet or a double or triple layer sheet. A sheet comprising four or more layers may be employed. At least one layer of the sheet is heat-shrinkable, and at least one layer contains a colorant, preferably carbon black, in an amount, for instance, 1 to 5 weight %, preferably 2 to 4 weight %, enough for imparting to the leader sheet the light-shielding property. The carbon black-containing layer may be produced by coating a heat-shrinkable plastic sheet with a carbon black-containing paint, or placing an independently prepared carbon black-containing film on a heat-shrinkable plastic sheet via an adhesive.

The resin material of the leader sheet may be polyethylene, polypropylene, polyvinyl chloride, polystyrene, styrene-butadiene copolymer, polyvinylidene chloride, polyester, or one of mixtures of these resin materials with an amorphous polyolefin. The amorphous polyolefin is preferably incorporated into the resin material in an amount of 5 to 90 weight %, preferably 60 to 90 weight %, more preferably 70 to 80 weight %. The incorporation of the amorphous olefin into the resin material for the preparation of the leader sheet is effective to impart to the leader sheet a high heat shrinkage ratio. The amorphous polyolefin preferably is a cyclic olefin-copolymer, and preferably shows a glass transition temperature (Tg) in the range of 60 to 120° C., more preferably 60 to 100° C.

The resin material of the heat shrinkable leader sheet is preferably made using a mixture of a polyethylene resin and the amorphous polyolefin. Preferred examples of the polyethylene resins include a low density polyethylene (LDPE), a linear low density polyethylene (LLDPE), and a high density polyethylene (HDPE). These polyethylene resins can be employed in combinations.

The heat-shrinkable light-shielding leader sheet of the invention is favorably produced by melt extrusion, particularly by the known inflation method. When the leader sheet of the invention is produced by the inflation method, a blow-up ratio (or a blow ratio) preferably is in the range of 0.5 to 1.5.

In the case that the heat-shrinkable leader sheet is wound twice or more on the photosensitive web roll, the overlapped heat-shrinkable leader sheets may sometimes adhere to each other, which disturbs unwinding of the photosensitive web. For obviating the adhesion, the leader sheet may be composed of a heat-shrinkable film and a heat-resistant layer or film arranged on the heat-shrinkable film. The colorant may be incorporated into the heat-shrinkable film or the heat resistant layer or film. The heat-resistant layer or film may be prepared using a thermo-setting resin, or a high heat-resistant resin such as polypropylene. The heat-resistant layer preferably has a heat resistance satisfying the condition that a softening or decomposing temperature of the heat-resistant layer is higher than 10° C. of a softening or decomposing temperature of the heat-shrinkable light-shielding plastic film. The heat-resistant layer may be placed on both sides of the heat-shrinkable light-shielding plastic film.

The heat-shrinkable light-shielding leader sheet of the invention can comprises a heat-shrinkable film and a light-shielding film. The heat-shrinkable film generally has a thickness of 10 to 100 μm, preferably 12 to 60 μm, more preferably 30 to 50 μm, and the light-shielding film (having a similar, less or no heat-shrinkable property) generally has a thickness of 20 to 100 μm, preferably 20 to 50 μm, more preferably 23 to 40 μm. The light-shielding film can comprise a resin material and a colorant such as carbon black. Examples of the resin materials are the same as described above for the resin material of the leader sheet.

The heat-shrinkable light-shielding leader sheet of the invention preferably has a tensile strength in the range of 1 to 3 kg/mm$^2$ in the direction along the longitudinal direction of the photosensitive web, and that in the range of 1.5 to 3.5 kg/mm$^2$ in the width direction. The tensile strength is measured according to the procedure described in JIS K 7127. The leader sheet of the invention preferably has a tensile elongation of 300 to 600% in both directions. The tensile elongation is also measured according to the procedure described in JIS K 7127. The leader sheet of the invention preferably has an initial modulus of 5,000 to 8,000 kg/cm$^2$ in the direction along the longitudinal direction of the photosensitive web, and that of 6,000 to 9,000 kg/cm$^2$ in the width direction. The initial modulus also is measured according to the procedure described in JIS K 7127. Further, the leader sheet of the invention preferably has a tearing strength (Elemendorf) of 50 to 150 gf in the direction along the longitudinal direction of the photosensitive web, and that of 100 to 200 gf in the width direction. The Elemendorf tearing strength is measured according to the procedure described in JIS K 7128. Further, the leader sheet of the invention preferably has a moisture permeability of 1.5 to 2.5 g/m$^2$·24 h, which is measured according to the procedure described in JIS Z 0208.

The light-shielding flange disc for the continuous light-shielding photosensitive web is well known. Any of the known light-shielding flange disc can be employable for the light-shielding packaging of the invention. The flange disc preferably has a core portion which is inserted into the core on which the photosensitive web is wound. The light-shielding flange disc comprises a resin material and a colorant such as carbon black. The resin material may be polystyrene, polypropylene, polyethylene, polycarbonate, or polyacetal, ABS resin. The preferred content of carbon black varies depending upon the thickness of the flange disc. For instance, a flange disc of 1 mm thick generally contains 1 to 15 wt. %, preferably 2 to 10 wt. %, more preferably 3 to 7 wt. %, of carbon black. The thickness of the flange disc generally is in the range of 1 to 3.5 mm, preferably 1.5 to 3 mm.

The light-shielding packaging of the invention is manufactured by causing heat shrinkage at the side portion of the leader sheet by applying a hot air or heating means to the side portion, after the leader sheet is wound to cover the circumference of the flange disc. The heating temperature is selected to approximately match with a temperature within 60 to 140° C. and at which the leader sheet shows a heat shrinkage ratio in the range of 5 to 30% in the longitudinal direction of the web at a temperature in the range of 60 to 140° C. and a heat shrinkage ratio of less than 5% in its width direction. The heat-shrinkage occuring in the side portions of the light-shielding leader sheet in the direction along the longitudinal direction of the continuous photosensitive web by the heating causes the side portion of the leader sheet to attach tightly onto the periphery of the light-shielding flange, so that satifactory light-shielding is attained. The attachment is well kept in the course of storing and transporting the packaged photosensitive web roll.

The present invention is further described by the following examples.

Example 1

(1) Preparation of heat-shrinkable light-shielding sheet

A linear low density polyethylene resin (LLDPE, Ultzex UZ 2021L, available from Mitsui Chemical Co., Ltd.), an amorphous cyclic olefin copolymer (COC, Apel 8008T, available from Mitsui Chemical Co., Ltd.), and carbon black (CB, mixture of DFD-011 available from Japan Unica Co., Ltd and Furnace H44 available from Mitsubishi Chemical Co., Ltd., 60 wt. %:40 wt. %) were mixed in ratios set forth in Table 1 and processed by an inflation method to give five continuous heat-shrinkable light-shielding sheets (No. 1 to No. 5) having the same thickness of 100 μm.

TABLE 1

| | LLDPE (wt. %) | COC (wt. %) | CB (wt. %) |
|---|---|---|---|
| No. 1 | 87 | 10 | 3 |
| No. 2 | 77 | 20 | 3 |
| No. 3 | 67 | 30 | 3 |
| No. 4 | 27 | 70 | 3 |
| No. 5 | 17 | 80 | 3 |

The heat-shrinkable light-shielding sheets (No. 1 to No. 5) were measured their heat shrinkage ratio in the longitudinal direction as well as the width direction in the range of 80 to 120° C., according to the procedure described in JIS Z 1709. The heat shrinkage ratio at temperatures lower than 100° C. was measured in water, and the heat shrinkage ratio at 100° C. or higher was measured in a silicone oil.

Figure 21:
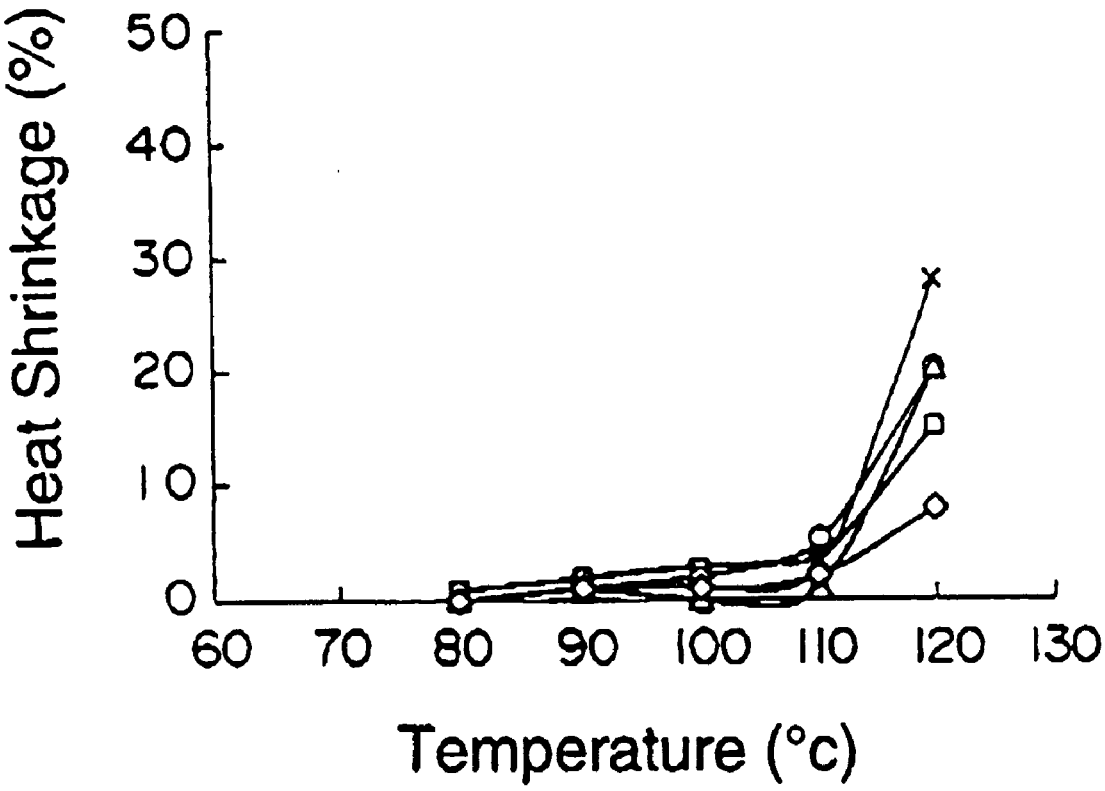
FIG. 21 graphically illustrates some examples of variation of a heat shrinkage ratio of the continuous heat-shrinkable light-shielding leader sheet of the invention, which are measured in its longitudinal direction at temperatures in the range of 80 to 120° C.

The measurements indicated that all light-shielding sheets have a heat shrinkage ratio of less than 2% in the width direction. The heat shrinkage ratios in the longitudinal direction are graphically illustrated in FIG. 21. In the graph of FIG. 21, a line connecting blanc rhombuses is for a sheet of No. 1, a line connecting blanc triangles is for a sheet of No. 2, a line connecting crosses is for a sheet of No. 3, a line connecting blank squares is for a sheet of No. 4 and a line connecting circles is for a sheet of No. 5.

Example 2

On each of the heat-shrinkable light-shielding sheets (thickness: 100 μm) prepared in Example 1 was placed with an adhesive (Takelack, available from Takeda Pharmaceutical Co., Ltd.) a propylene sheet (Mirason, available from Mitsui Chemical Co., Ltd.) having a thickness of 30 μm.

Using thus prepared heat-shrinkable light-shielding sheets consisting of two sheet layers, light-shielded packaging illustrated in FIG. 6 were manufactured.

Example 3

On both surfaces of a heat-shrinkable film (Randy five VP-B50, thickness: 50 μm, available from Okura Kogyo Co., Ltd.) were laminated a light-shielding film (UZ-2021L, made of LLDPE, thickness: 35 μm, carbon content: 3.0 wt. %), to prepare a heat-shrinkable light-shielding leader sheet of composite structure of FIG. 18. The prepared leader sheet had the following heat shrinkage ratios:

| Direction | 90° C. | 100° C. | 110° C. |
|---|---|---|---|
| Longitudinal | 5% | 9% | 18% |
| Width | 1% | 1% | 2% |

Using thus prepared heat-shrinkable light-shielding sheet of composite structure, light-shielded packaging illustrated in FIG. 6 were manufactured.

What is claimed is:

1. A continuous photosensitive web having at least at its one end a heat-shrinkable light-shielding leader sheet having a thickness of 30 to 200 μm and comprising a resin material and a colorant which shows a heat shrinkage ratio in the range of 5 to 30% in the longitudinal direction of the web at a temperature in the range of 60 to 140° C. and a heat shrinkage ratio of less than 5% in its width direction at that temperature.

2. The photosensitive web of claim 1, wherein a ratio of the heat shrinkage ratio of the leader sheet in the longitudinal direction to the heat shrinkage ratio in the width direction is 3 or more.

3. The photosensitive web of claim 1, wherein the resin material of the leader sheet comprises 5 to 90 weight % of amorphous polyolefin and 95 to 10 weight % of one or more other resin components.

4. The photosensitive web of claim 1, wherein the leader sheet consists essentially of an inner leader segment having a width larger than the width of the photosensitive web and an outer leader segment having a width larger than the width of the inner leader segment.

5. The photosensitive web of claim 4, wherein the width of the photosensitive web, the width of the inner leader segment, and the width of the outer leader segment satisfy the following conditions:

width of the photosensitive web=W width of the inner leader segment=W+2X width of the outer leader segment=W+2Y

Y>3X.

6. The photosensitive web of claim 4, wherein the inner leader segment is connected to the outer leader segment via a tapered segment.

7. The photosensitive web of claim 1, wherein the leader sheet comprises a heat-shrinkable light-shielding plastic film comprising a resin material and a colorant and a heat-resistant layer arranged on at least one surface side of the plastic film, said heat-resistant layer having a softening or decomposing temperature higher than 10° C. of a softening or decomposing temperature of the heat-shrinkable light-shielding plastic film.

8. The photosensitive web of claim 7, wherein the heat-resistant layer has a thickness in the range of 1/40 to 30/40 per the thickness of the heat-shrinkable light-shielding plastic film.

9. The photosensitive web of claim 7, wherein the heat-resistant layer is made of a thermosetting resin.

10. The photosensitive web of claim 1, wherein the leader sheet comprises a heat-shrinkable plastic film and a light-shielding film comprising a resin material and a colorant which is arranged on at least one surface side of the heat-shrinkable plastic film.

11. The photosensitive web of claim 10, wherein the heat-shrinkable plastic film has on both surface sides the light-shielding film.

12. The photosensitive web of claim 10, wherein the heat-shrinkable plastic film has a thickness in the range of 20 to 100 μm and the light-shielding film has a thickness in the range of 20 to 100 μm.

13. A light-shielding packaging for a roll of continuous photosensitive web wound on a core having on its both ends a light-shielding flange disc, which has at its leading end a heat-shrinkable light-shielding leader sheet having a thickness of 30 to 200 μm and comprising a resin material and a colorant which shows a heat shrinkage ratio in the range of 5 to 30% in the longitudinal direction of the web at a temperature in the range of 60 to 140° C. and a heat shrinkage ratio of less than 5% in its width direction at the temperature, said leader sheet having a length larger than the length of the outermost convolution of the roll and a width larger than the distance between the outer face of one flange disc and the outer face of another flange disc, and each side portion of the leader sheet being light-tightly attached via heat shrinkage thereof to the outer face of the flange disc at least at a portion adjacent to the periphery of the flange disc.

14. The light-shielding packaging of claim 13, wherein a ratio of the heat shrinkage ratio of the leader sheet in the longitudinal direction to the heat shrinkage ratio in the width direction of the leader sheet is 3 or more.

15. The light-shielding packaging of claim 13, wherein the resin material of the leader sheet comprises 5 to 90 weight % of an amorphous polyolefin and 95 to 10 weight % of one or more other resin components.

16. The light-shielding packaging of claim 13, wherein the leader sheet comprises a heat-shrinkable plastic film and a light-shielding film comprising a resin material and a colorant which is arranged on each surface side of the heat-shrinkable plastic film.

17. The light-shielding packaging of claim 13, wherein the leader sheet consists essentially of an inner leader segment having a width larger than the width of the photosensitive web and an outer leader segment having a width larger than the width of the inner leader segment.

18. The light-shielding packaging of claim 17, wherein the width of the photosensitive web, the width of the inner leader segment, and the width of the outer leader segment satisfy the following conditions:

width of the photosensitive web=W width of the inner leader segment W+2X width of the outer leader segment W+2Y

Y>3X.

19. The light-shielding packaging of claim 17, wherein the inner leader segment is connected to the outer leader segment via a tapered segment.

20. The light-shielding packaging of claim 19, wherein the tapered segment has a length in the longitudinal direction of the photosensitive web more than ¼ based on the length of the outermost convolution of the photosensitive web.

* * * * *